United States Patent [19]

Peter

[11] Patent Number: 4,471,585

[45] Date of Patent: Sep. 18, 1984

[54] DOMED SUPPORT FRAMEWORK

[76] Inventor: Emil Peter, Dammweg, 8460 Marthalen, Switzerland

[21] Appl. No.: 407,109

[22] Filed: Aug. 11, 1982

[30] Foreign Application Priority Data

Aug. 14, 1981 [CH] Switzerland ..... 5274/81

[51] Int. Cl.[3] ..... E04B 7/12

[52] U.S. Cl. ..... 52/18; 52/86; 52/644

[58] Field of Search ..... 52/80, 18, 644, 86, 52/83, 233, 236; 14/9, 10, 11, 12

[56] References Cited

U.S. PATENT DOCUMENTS

| | | | |
|---|---|---|---|
| 3,591,991 | 7/1971 | Zeflin | 52/18 |
| 3,841,038 | 10/1974 | Geiger | 52/80 |
| 3,982,361 | 9/1976 | Deutsch et al. | 52/80 |
| 4,074,502 | 2/1978 | Peter | 52/83 |
| 4,271,641 | 6/1981 | Kawaguchi | 52/80 |
| 4,275,537 | 6/1981 | Pinson | 52/223 R |
| 4,357,782 | 11/1982 | Peter | 52/18 |

FOREIGN PATENT DOCUMENTS

| | | | |
|---|---|---|---|
| 1135152 | 8/1962 | Fed. Rep. of Germany | 52/86 |
| 25984 | 2/1953 | Finland | 52/18 |
| 438652 | 12/1967 | Switzerland | 52/86 |

*Primary Examiner*—John E. Murtagh
*Assistant Examiner*—Andrew Joseph Rudy
*Attorney, Agent, or Firm*—Diller, Ramik & Wight

[57] ABSTRACT

In a domed support framework tension domes and the compression domes are arranged side-by-side, neighboring domes thereby being arched oppositely with respect to one another. The tension domes and compression domes are carried by common intermediate supports and outer supports. Transversely to the doming direction continuous tension elements are spanned between the outer supports, extending in a funicular polygon or in a catenary configuration alternatingly through the tension domes and longitudinal extensions of the compression domes and being guided over the intermediate supports. Each tension element is frictionally connected with reinforcement ribs of the compression domes and with roof from elements of the tensions domes. The tension elements cause deflection forces which in each dome compensate for the opposed arch pressure forces. Thereby a horizontal force balance between neighboring tension and compression domes is achieved by simultaneously transmitting the vertical forces to the supports.

14 Claims, 11 Drawing Figures

DOMED SUPPORT FRAMEWORK

BACKGROUND OF THE INVENTION

The invention relates to a new and improved construction of an arched or domed support framework or truss, especially for roof constructions, which is of the type comprising at least a tension dome and a compression dome, which are oppositely arched in lengthwise direction, arranged adjacent to one another in the arching direction and at their ends mounted upon a common intermediate support and outer supports, the compression dome and the tension dome comprising reinforcement ribs and roof form elements, respectively, oriented and taking up load in the dome direction.

A support framework of the aforementioned type has been disclosed, e.g. in German Patent Publication No. 30 21 672. Therein each tension dome at its end is provided with a transverse tension element which is anchored in the adjacent compression domes, thereby transmitting the tension forces of the tension dome into the adjacent compression domes. For each of these tension elements however, own anchoring and prestressing means are necessary which in large constructions cause considerable additional costs corresponding to the number of anchoring and pretensioning locations. This known construction therefore is afflicted with the drawback of having a relatively high number of separate tension elements, which especially in large frameworks comprising a plurality of compression and tension domes is disadvantageous.

SUMMARY OF THE INVENTION

Therefore, it is a primary object of the present invention to provide for a domed support framework of the aforementioned type which, however, is applicable to large structures with a plurality of compression domes and tension domes, without needing a large amount of anchoring and prestressing locations for the mentioned tension elements.

Now in order to implement these and still further objects of the invention which will become more readily apparent as the description proceeds, the invention contemplates that transversely to the arching direction continuous tension elements are spanned between the outer supports at least along respective edges of the framework, which tension elements have a funicular polygon or a catenary configuration and alternatively pass through the tension domes and longitudinal extensions of the compression domes having respectively alternating curvature wherein said tension elements being guided over the intermediate supports and anchored at the outer supports.

According to an advantageous construction of the invention the framework comprises a plurality of compression domes and tension domes, wherein longitudinal adjacent domes alternatively are of different type, i.e. each compression dome is followed by a tension dome, and wherein laterally adjacent domes are of different type, said tension elements additionally extending along each transverse boundary line between the domes.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 2:
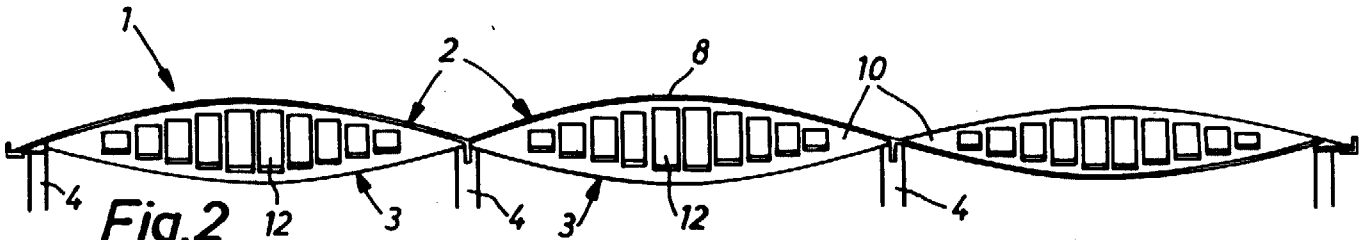
FIG. 2 is a longitudinal sectional view through the framework substantially taken along the line II—II of FIG. 4.
Figure 1:
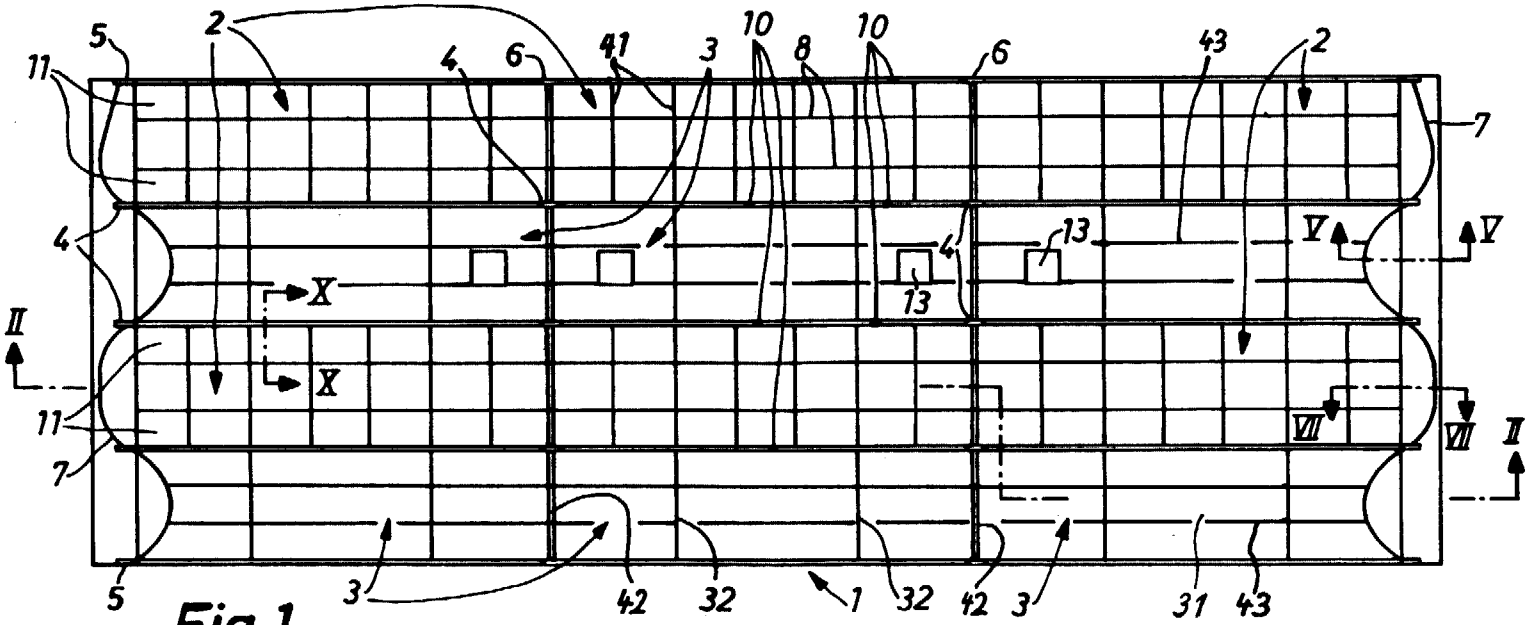
FIG. 1 is a bottom plan view of a first embodiment of a domed support framework constructed according to the present invention.

Describing now the drawings, we first turn to FIGS. 1 and 2, illustrating a first embodiment of the invention. In the longitudinal direction, i.e. in the arching direction, only domes of the same type, i.e. compression domes 2 or tension domes 3, are combined in this embodiment to form longitudinal rows of tension domes and of compression domes, respectively. The domes 2,3 are supported at their corners upon supports 4,5,6. Whereas at the boundary lines between lengthwise adjacent tension domes 3 and compression domes 2, respectively, the horizontal arch forces are balanced and compensate each other, the same is not true at the end of each of said rows. These uncompensated arch forces, which are present along both edges of the framework 1 in the doming direction, are absorbed substantially by two tension elements 7, each of which extends transversely along one of the edges of the framework 1 between two of its corner supports 5 and is guided over the interposed intermediate supports 4. The pretensioned tension elements 7, which have a three dimensional catenary configuration and extend through the tension domes 3 as well as through longitudinal extensions of the compression domes 2, cause deflecting forces by which opposite arch forces are compensated, thereby resulting in a horizontal balance of the compression and tension forces of adjacent compression and tension domes and simultaneously in a vertical load transfer to the supports 4,5. Laterally adjacent tension domes 3 and compression domes 2 are connected to each other by girders 10 wherein there are windows 12. In the embodiment of FIGS. 1 and 2 all the windows of one longitudinal row of domes are exposed to the same side, i.e. they form strings of lighting apertures extending over the whole length of the framework.

Figure 4:
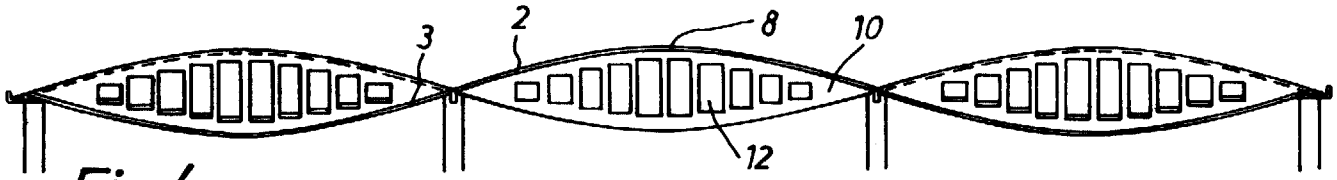
FIG. 4 is a longitudinal sectional view through the framework of FIG. 3 substantially taken along the line IV—IV in FIG. 3.
Figure 3:
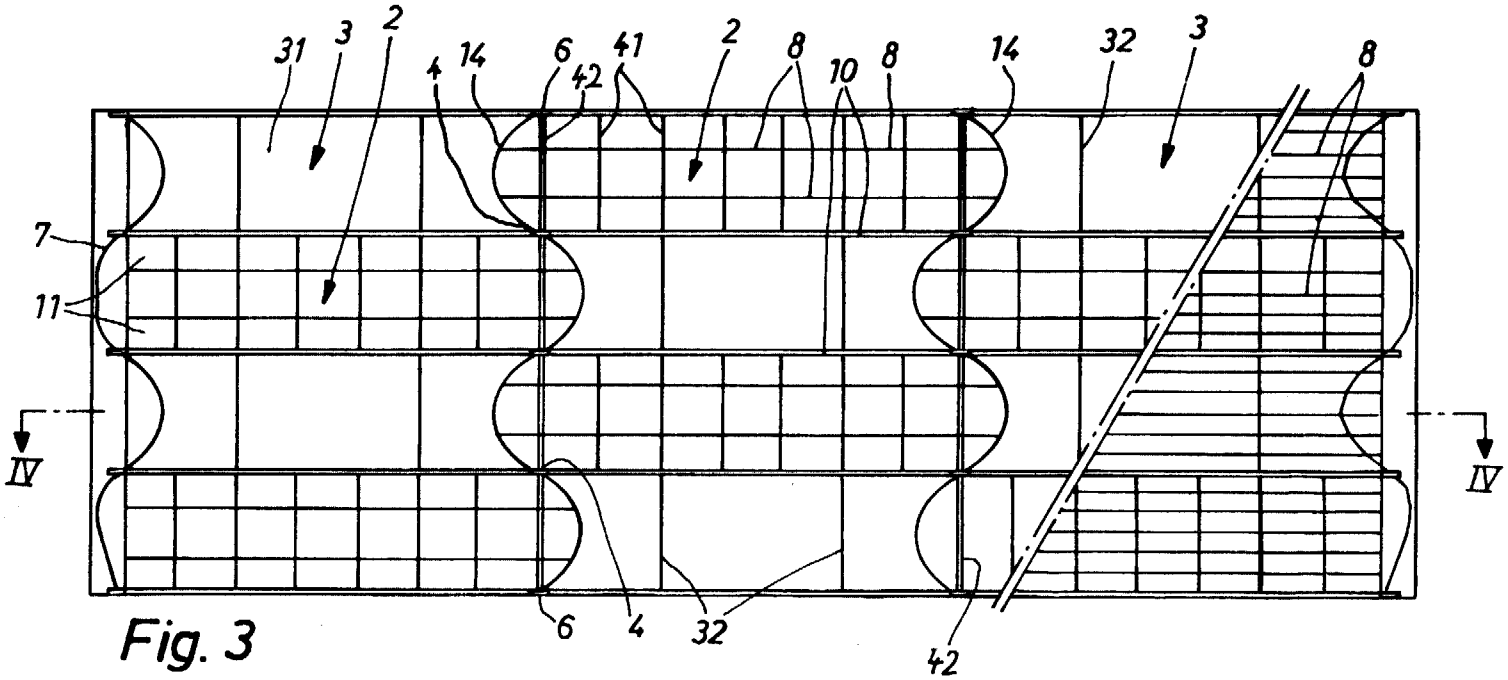
FIG. 3 is a bottom plan view of a second embodiment of a domed framework according to the invention, wherein on the left hand side a tension element having a catenary configuration is shown whereas on the right hand side an embodiment having a tension element formed as funicular polygon is illustrated.

The embodiment of the FIGS. 3 and 4, on the other hand, is formed as a wave-shaped roof, i.e. compression domes 2 and tension domes 3 are alternatingly arranged in arching direction. Therefore, in a longitudinal sectional view (FIG. 4) the roof has a wave-like shape. Laterally adjacent rows of compression and tension domes are displaced to each other by a half "wavelength" such that in transverse direction each compression dome 2 is adjacent to a tension dome 3 and vice versa. However, in contrast to the embodiment of the FIGS. 1 and 2, the horizontal forces at the transverse boundary lines of longitudinally adjacent domes are not compensated. Therefore, transversely extending tension elements 14 are provided, which extend substantially along the boundary lines through the tension domes 3 and are guided over the intermediate supports 4. They are anchored in the region of outer supports 6. These tension elements absorb the compression and the tension forces along each inner boundary line, so that the horizontal forces of laterally adjacent rows of domes 2,3 are absorbed and compensated by the respective transverse tension elements 14. The vertical forces are transmitted to the supports. Between the outer supports 6 a transversely extending rib 42 is placed for absorbing the transverse pressure exerted by the respective tension elements 14. As can be seen from FIG. 3, adjacent tension elements 14 have a complementary opposite shape which necessarily follows from the forces caused by this arrangement of the domes 2,3.

On the right hand side of FIG. 3 an alternative version of the tension element 7 formed as a funicular polygon and composed of a plurality of straight rods is illustrated. The rods are connected to longitudinal ribs 8.

In the embodiment of FIGS. 3 and 4 the windows 12 formed in the girders 10 are alternatingly exposed for longitudinally successive domes. Consequently, the windows 12 are distributed over the framework in a staggered array. The cross section of FIG. 4 is to be understood to show part of the windows 12 from the outside. Only the windows of the central dome of FIG. 4 are looked at from the inside in this figure.

Figure 5:
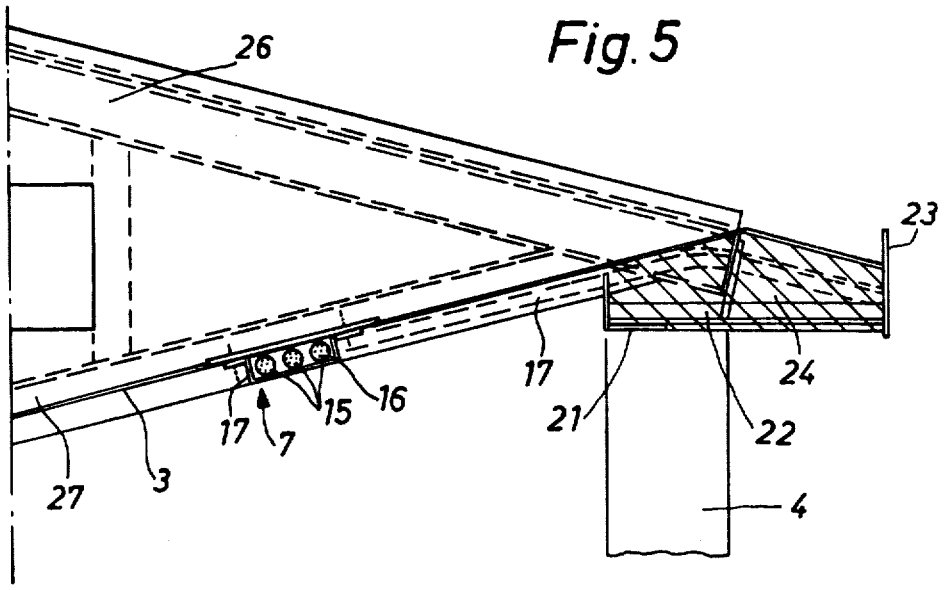
FIG. 5 is a cross sectional view taken along the line V—V in FIG. 1.
Figure 7:
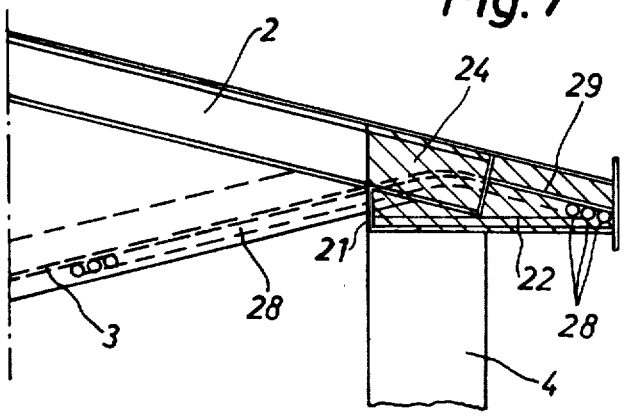
FIG. 7 is a cross sectional view taken along the line VII—VII in FIG. 1.

As to a detailed explanation of the shape and construction of the tension elements 7 in the zone of the intermediate supports 4, we refer to the following comment in connection with FIGS. 5 and 7.

From the FIGS. 2 and 4 the shape of the domes can be seen. The compression domes 2 preferably have a line of pressure which is shaped as a funicular polygon. In this case the longitudinal ribs 8 (see FIGS. 1 and 3) are preferably composed of straight rods or structural girders connected to each other by transverse ribs 11. Thereby the costs of the construction can be reduced. The tension domes 3, however, are shaped in catenary configuration. The height of the compression domes 2 does not necessarily correspond to the depth of the tension domes 3, as can be seen from FIG. 2, but can be less. If the length of the domes is relatively short it is not necessary to use the whole width of compression domes for taking up the compression forces, but it is sufficient to provide two sections of transverse ribs 11 along the upper chord of the girder 10 with a structure of high buckling strength. The curvature of the tension elements 7 extending along the edges of the framework 1 therefore is choosed to be higher in the zone of the sections whereas the path of the tension element 7 between these sections is substantially straight (FIG. 1).

If the load on the framework has an equal distribution over the whole surface then the domes 2,3 and the girders 10 are free of transverse forces so that no struts are needed in the zone of the windows 12 in the girders. The deformation of the tension domes 3 resulting from local additional loads does not cause any problem, since the catenary shape of the thin tension domes adapts itself to the deflection curve.

Figure 6:
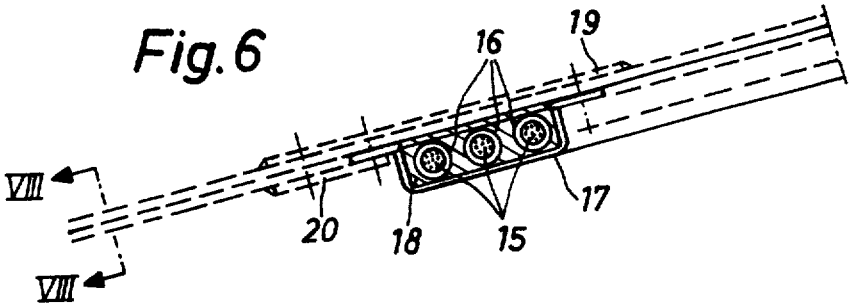
FIG. 6 is an enlarged detail from FIG. 5 of an embodiment using pretensioning cables as tension element.

By means of FIGS. 5,6 and 7 the path of a tension element 7 along the edge of the framework 1 will be explained in more detail. In FIG. 5 a cross section through a tension dome 3 in the zone of the eaves is shown, taken along the line V—V in FIG. 1. The upper chord 26 and the lower chord 27 of the girder 10 can be seen in plain view. The tension element 7 comprises three pretensioning cables 15, which are contained within encasing tubes 16, as can be seen from FIG. 6. The encasing tubes 16 containing the pretensioning cables are placed within a U-shaped profile member 17, which in turn is connected with the tension dome 3. The tensioning cables 15 are embedded in cement mortar 18. To reinforce the tension element in this zone there are plates 19,20 which are bolted to the tension element and to the U-shaped profile member 17. In the zone of the eaves there is a frame with rigid joints having a transverse element 21, to which L-shaped profiles 22 are connected, which in turn are fixed to an end cover 23. Said frame is filled with concrete 24. In FIG. 7 a longitudinal cross section through a compression dome 2 in the zone of the eaves is shown. In the illustrated embodiment the tension element comprises three round steel bars 28, which in the area of the compression domes 2 are fixed to an element 29 which is a part of said frame. In the tension domes 3 the round steel bars are directly fixed to its roof form elements, as indicated on the left hand side of FIG. 7.

Figure 8:
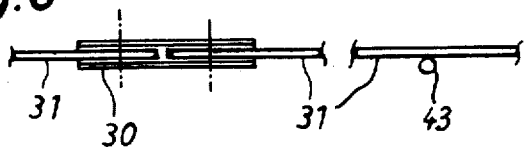
FIG. 8 is a cross sectional view taken along the line VIII—VIII in FIG. 6.

The tension domes 3 are provided with longitudinal tension flanges 30 (FIG. 8), which assume catenary shape. Steel plates 31 are bolted to these tension flanges and extend on both sides of each flange to form the surface of the roof. The necessary thickness d of the used steel plates depends on the length of the domes and has the following values (for an assumed maximum snow load of 100 kg/m$^2$):

TABLE 1

| Length of the tension dome: | Thickness of the steel plates | In the case of mounting round steel bars 43 below the tension dome: |
|---|---|---|
| l = 20 m | d = 1,2 mm | |
| l = 40 m | d = 2,5 mm | |
| l = 60 m | d = 4 mm | |
| l = 80 m | d = 6,4 mm | d' = 5 mm |
| l = 100 m | d = 8,8 mm | d' = 6 mm |
| l = 120 m | d = 11,5 mm | d' = 7 mm |
| l = 140 m | d = 14,6 mm | d' = 8 mm |

Figure 11:
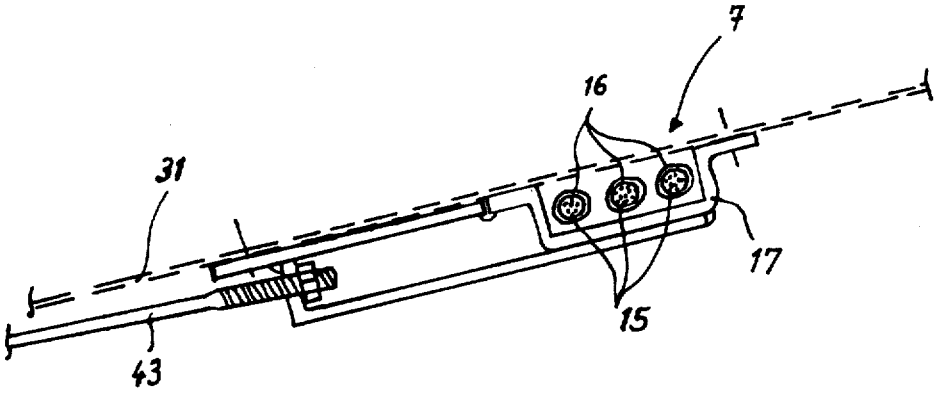
FIG. 11 illustrates the connection of a tie rod of an embodiment of the invention to the tension element.

For large span widths of the domes the thickness of the steel plates can be reduced by using round steel bars 43 arranged under the roof form elements (FIGS. 1,11). In FIG. 11 the connection of one of these steel bars 43 to the tension element 7 is illustrated. The reduced thickness d' of the steel plates necessary in this case can be taken from table 1.

Figure 9:
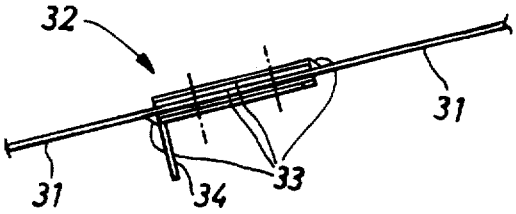
FIG. 9 is a cross sectional view in longitudinal direction of an intersection between roof form elements of a tension dome.

In FIG. 9 a transverse joint of the steel plates 31 of the tension domes 3 is illustrated, which extends transversely to the arching direction (see also FIGS. 1 and 3). The steel plates 31 are connected by means of welded connecting stripes, the location of the welds 33 being indicated in FIG. 9. The lower connecting stripe 34 is L-shaped in order to form a transverse bracing rib.

Figure 10:
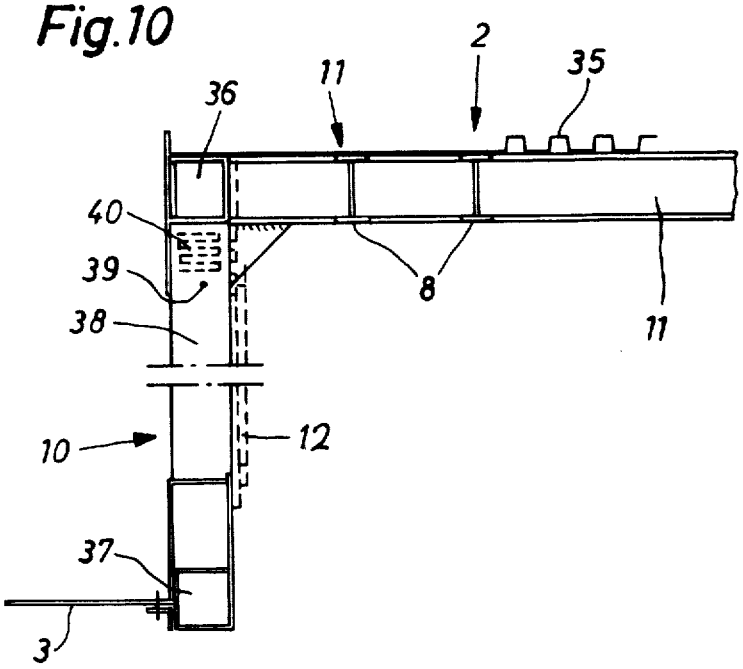
FIG. 10 is a cross sectional view taken along the line X—X in FIG. 1.

Finally, in FIG. 10 a cross section through the girder 10 in the zone of a window is shown, corresponding to the line X—X in FIG. 1. The girder 10 forms a connection between a compression dome 2 and a laterally adjacent tension dome 3. In the compression dome 2 one of the sections 11 with high buckling strength is illustrated, having two longitudinal ribs 8 to which the central section made of a corrugated sheet-metal covering 35 is joined. As already explained above, the compression domes are provided with transverse ribs 41 formed by I-shaped iron bars. The girder 10 has upper and under chords 36,37 in the form of hollow profiles which are connected to each other by window posts 38, which are also hollow profiles. In the window frames there is space for a window curtain 40. The windows 12 are preferably formed as skylights. The vertical position of the windows in the framework is advantageous in that the windows can easily be cleaned from the roof and in that commercially available products can be used.

When erecting the afore mentioned frameworks, the frame with rigid joints in the zone of the eaves is mounted first. Then, the tension elements 7, 14 are installed, i.e. the U-shaped profile members 17 are mounted, followed by fixing the encasing tubes 16, containing the prestressing cables 16, by means of cement mortar. Consequently, the girders 10 and the transverse and longitudinal ribs 8 an 41, respectively, are mounted, whereafter the tension flanges 30 of the tension domes can be stretched to which the steel plates 31 are bolted. After the sheet-metal covering 35 of the compression dome 2 has been fixed, the pretensioning cables 15 can be tensioned and the encasing tubes 16 can be pressed out by means of injection cement mortar.

The above described domed support framework of the invention is an advantageous alternative to the known structures. The disclosed construction of the invention results in smooth upper and lower surfaces of the roof, which is advantageous in aesthetical respect as well as with regard to the maintenance (cleaning) of the roof. In addition, it is easy to fix isolation layers on its surfaces. The statically favourable shape of the tension domes results in a relatively little weight of the construction even for large span widths so that thin steel plates can be used which need not to be preformed but can merely be mounted on the tension flanges 30 and adapt themselves to the curvature of the dome caused by its own weight. Furthermore, it is not needed to use heavy and expensive means for absorbing the horizontal doming forces, which are substantially balanced by means of the tension elements 7, extending transversely through the compression and tension domes.

While there are shown and described present preferred embodiments of the invention, it is to be understood that the invention is not limited thereto, but may be otherwise variously embodied and practised within the scope of the following claims. ACCORDINGLY,

What is claimed is:

1. In a domed framework, especially for roof construction, having a plurality of compression and tension domes, said compression and tension domes being arched oppositely with respect to one another in the same arching direction and laterally adjacently arranged, said compression and tension domes having associated corners, lateral outer supports and intermediate supports for supporting the domes at their corners, a tension element at least at each transverse edge of the framework, said tension element spanning between two lateral outer supports and being guided over all intermediate supports between said outer lateral supports, each tension element extending continuously through said adjacent tension and compression domes transversely to the arching direction with alternating curvature in at least one of a funicular polygon and catenary path, means for connecting each tension element to said compression and tension domes, and means for anchoring each tension element.

2. The domed framework as defined in claim 1, wherein said plurality of tension domes and compression domes are alternatingly arranged side-by-side and a plurality of intermediate common suports means, each of said tension elements is guided over all of said intermediate common support means between the respective outer support means in catenary or funicular polygon configuration.

3. The domes framework as defined in claim 1, wherein:

each of said tension elements comprises encasing tubes containing pretensioning cables, and encasing tubes being carried by U-shaped profile members and fixed therein by means of cement mortar.

4. The domed framework as defined in claim 1, wherein said plurality of tension domes and compression domes are laterally and longitudinally combined with each other, every longitudinal row of domes only comprises one type of domes, i.e. tension domes or compression domes, whereas adjacent rows comprise domes of different type, the laterally adjacent domes of different type being connected to each other by means of girders and supported by means of common intermediate support means.

5. The domed framework as defined in claim 1, wherein said plurality of tension domes and compression domes are laterally and longitudinally combined with each other, longitudinally and laterally adjacent domes alternatingly are of different type, each compression dome being followed by a tension dome in each direction; the laterally adjacent domes of different type being connected to each other by means of girders and supported by means of common support means, said framework further including:

additional tension elements extending substantially along the boundary lines of adjacent lateral rows of domes in catenary or funicular polygon configuration.

6. The domed framework as defined in claim 5, wherein:

each of said additional tension elements is spanned between corresponding outer support means and is guided over the common intermediate supports such that it passes exclusively through tension domes adjacent to the boundary lines.

7. The domed framework as defined in claim 1, wherein:

the compression domes are reinforced by means of transverse and longitudinal ribs.

8. The domed framework as defined in claim 1, wherein:

all the elements taking up load are made of metal.

9. The domed framework as defined in claim 1, wherein the tension domes comprise longitudinal tension flanges and wherein at least for large span widths additional longitudinal round steel bars are provided, to which flanges and bars steel plates forming the roof form elements are secured.

10. The domed framework as defined in claim 1 wherein said intermediate supports are common to adjacent domes.

11. The domed framework as defined in claim 1 wherein said tension domes each have longitudinal flanges and steel plates mounted thereto, and said compression domes each have longitudinal reinforcement ribs.

12. The domed framework as defined in claim 1 wherein said tension domes each have longitudinal flanges and steel plates mounted thereto, said compression domes each have longitudinal reinforcement ribs, and means for connecting said tension and compression domes to said tension flanges and said reinforcement ribs, respectively.

13. The domed framework as defined in claim 1 wherein said intermediate supports are common to adjacent domes, said tension domes each have longitudinal flanges and steel plates mounted thereto, said compression domes each have longitudinal reinforcement ribs, and means for connecting said tension and compression domes to said tension flanges and said reinforcement ribs, respectively.

14. The domed framework as defined in claim 1 wherein each of the compression domes have two lateral sections along the upper cord of the girders with a structure of high buckling strength and an intermediate zone between the sections, and the tension elements which extend along the framework are shaped to have higher curvature in said lateral sections than in said intermediate zone.

* * * * *